US005915914A

United States Patent [19]

Hadiken

[11] Patent Number: 5,915,914

[45] Date of Patent: Jun. 29, 1999

[54] LOADER BUCKET WITH SPILL GUARD

[76] Inventor: Lawrence Hadiken, Box 36, Group 355, R.R.#1, Winnipeg, Manitoba, Canada, R3C 2E7

[21] Appl. No.: 08/568,318

[22] Filed: Dec. 6, 1995

[51] Int. Cl.[6] ..... E02F 9/24

[52] U.S. Cl. ..... 414/722; 37/411

[58] Field of Search ..... 414/722; 37/341, 37/411, 444; 296/152; 280/749

[56] References Cited

U.S. PATENT DOCUMENTS 3,121,964 2/1964 Cobb ..... 414/722 X
4,023,309 5/1977 Backward ..... 296/152 X
4,604,025 8/1986 Hammoud ..... 414/722 X
4,626,163 12/1986 Link et al. ..... 414/722

*Primary Examiner*—Donald W. Underwood
*Attorney, Agent, or Firm*—Adrian D. Battison; Murray E. Thrift

[57] ABSTRACT

A spill guard at the rear wall of the bucket of a loader is modified by providing a series of plates which are inclined to planes at right angles to the rear wall of the bucket at an angle of 45° to the planes and to the plane of the rear wall of the bucket. The plates allow the driver to view through the spill guard between the plates. The spill guard plates however prevent any material including small particulate material from falling between the plates when the bucket is raised in view of the inclined angle of the plates.

4 Claims, 3 Drawing Sheets

LOADER BUCKET WITH SPILL GUARD

BACKGROUND OF THE INVENTION

This invention relates to a loader of the type having a vehicle frame, a cab mounted on the frame for receiving a driver, a pair of loader arms extending forwardly from the frame and mounted at the arm for pivotal movement about a horizontal axis of the frame, lift cylinders for raising and lowering the arms about the lift axis and a bucket mounted on the forward end of the arms for pivotal movement about a horizontal bucket axis on the arms. The bucket includes actuation cylinders for pivoting the bucket about the horizontal bucket axis. The bucket has a bottom lift wall, a rear lift wall extending upwardly and forwardly from the rear edge of the bottom lift wall and two side walls.

The spill guard itself is mounted on the bucket at a top edge of the rear lift wall and extends upwardly therefrom.

Conventionally the spill guard includes a pair of posts and a plurality of horizontal louvers arranged at right angles to the post and at right angles to a plane containing the posts. The spill guard is used to restrict the spillage of material from the bucket over the rear edge in the raised position of the arms since this material can fall upon the vehicle frame, the arms and the cab causing damage.

SUMMARY OF THE INVENTION

It is one object of the present invention to provide an improved spill guard.

According to the invention, therefore, there is provided a loader comprising: a vehicle frame; a cab mounted on the frame for receiving a driver; a pair of loader arms extending forwardly from the frame and mounted thereon for pivotal movement about a horizontal lift axis on the frame; lift cylinder means for raising and lowering the arms about the lift axis; a bucket mounted on a forward end of the arms for pivotal movement about a horizontal bucket axis on the arms; pivot means for driving the bucket in said pivotal movement; the bucket having a bottom lift wall, a rear lift wall extending upwardly and forwardly from a rear edge of the bottom lift wall and two side walls; and a spill guard mounted on the bucket at a top edge of the rear lift wall and extending upwardly therefrom, the spill guard comprising a pair of posts upstanding from the rear wall and substantially coplanar therewith and a plurality of planar louver plates connected across and supported by the posts, the louver plates being parallel and spaced to allow viewing therebetween, the louver plates being arranged so as to be inclined at an angle to a plane at right angles to the plane of the posts in a direction so that a front edge of each louver plate is closer to the bucket than a rear edge of said each louver plate whereby an operator can see downwardly and forwardly between the louver plates when the arms are in a lowered position and the louver plates are inclined to the vertical in a raised position of the arms so as to prevent material from dropping between the louver plates.

Preferably the louver plates are arranged at an angle of approximately 45° to the plane at right angles to the plane of the posts.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
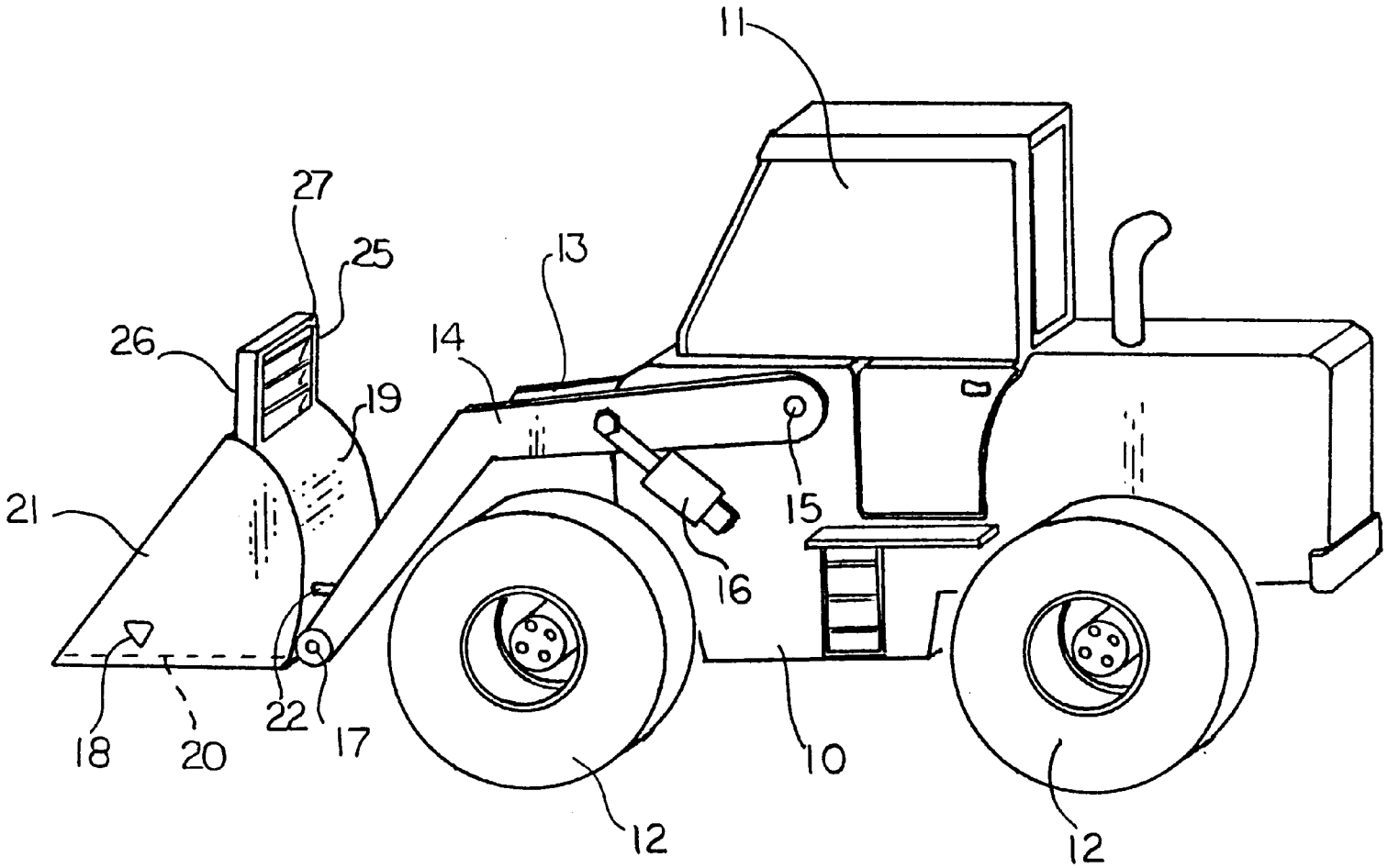
FIG. 1 is a schematic isometric view of a loader according to the present invention.

The conventional loader well known in the prior art comprises a vehicle having a vehicle frame 10 and a cab 11 mounted on ground wheels 12 for movement across the ground. At the front of the vehicle is provided a pair of lift arms 13 and 14 each of which can be raised and lowered about a common horizontal pivot axis 15 by a pair of lift cylinders 16. The arms extend forwardly and then downwardly and have at the lower front end a support defining a pivot axis 17 for a bucket 18 which can pivot about the pivot axis defined across the front of the arms. The bucket includes a rear wall 19, a base wall 20 and two side walls 21. The bucket can be pivoted about the pivot axis 17 by a pair of cylinders 22. On top of the rear wall 19 of the bucket is provided a spill guard 25.

Figure 2:
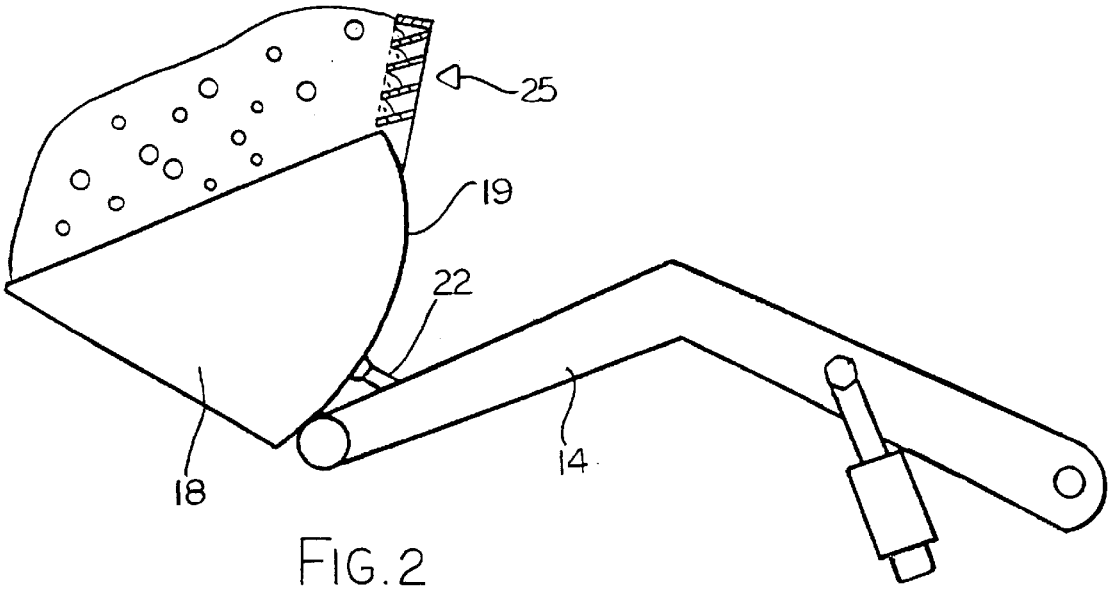
FIG. 2 is a side elevational view of the front part of the loader of FIG. 1.
Figure 4:
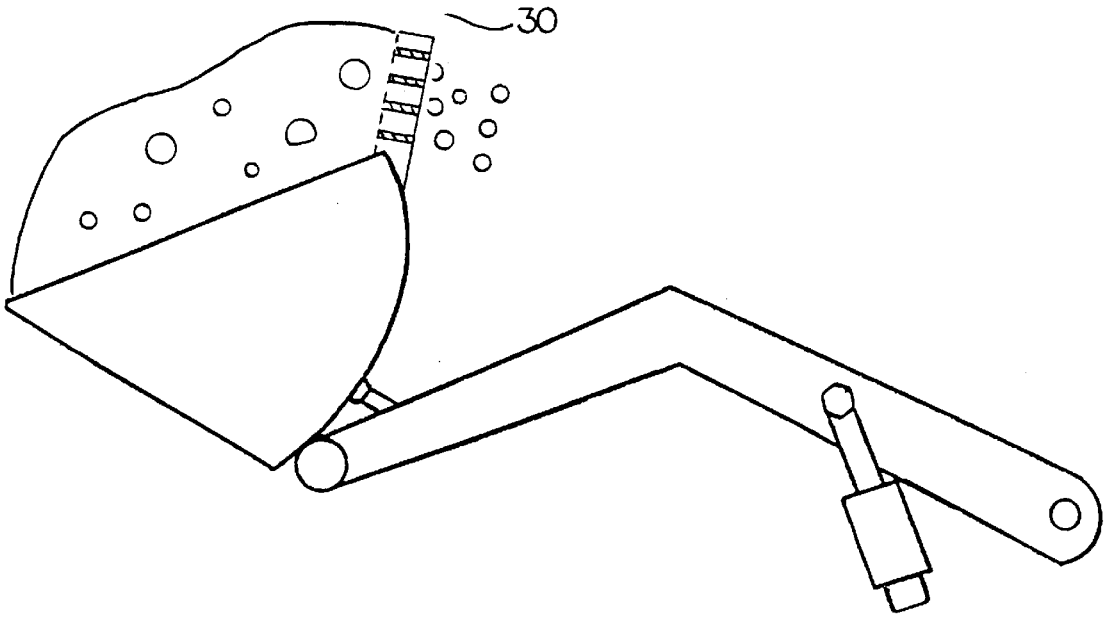
FIG. 4 PRIOR ART
FIG. 4 shows the prior art arrangement of a spill guard.

The spill guard comprises a pair of posts 26 and 27 each mounted at a respective end of the rear wall of the bucket so as to stand vertically upwardly therefrom substantially in the same plane as the rear wall as best shown in FIG. 2.

In the prior art the spill guard includes a plurality of louvers 30 welded across the posts 25 and 26 at right angles to the length of the posts and at right angles to a plane containing the posts.

Figure 3:
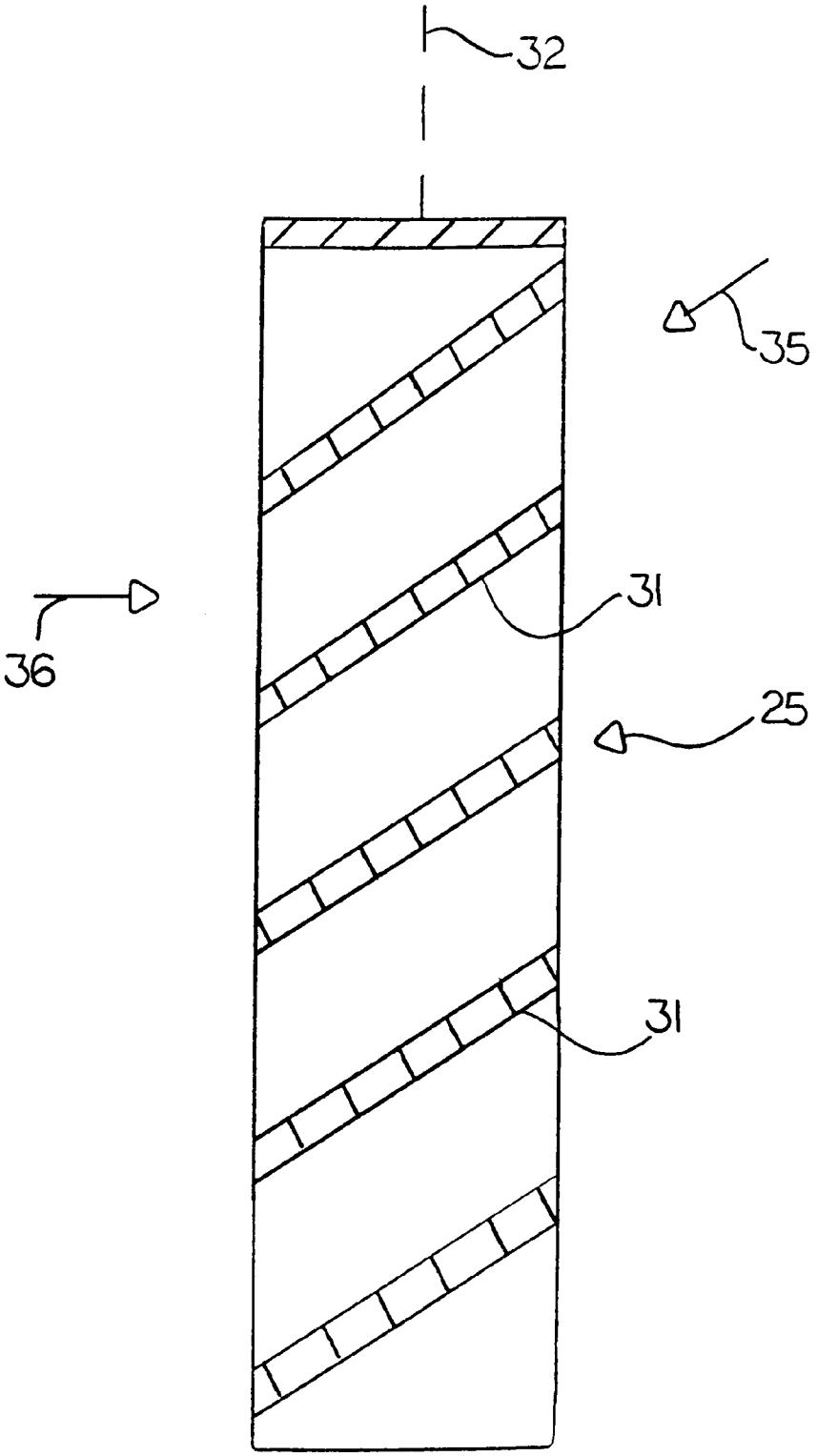
FIG. 3 is a cross sectional view through the spill guard of FIGS. 1 and 2.

As shown best in FIG. 3, the louvers of the present invention indicated at 31 are modified so that the louvers are parallel but lie at an inclined angle to a plane 32 containing the posts and inclined to align at right angles to the plane 32. In the preferred arrangement as shown the louvers are arranged at an angle of the order of 45° to these directions. The louvers are formed from rigid sheet metal of sufficient strength to resist the impact from the type of heavy material carried by a loader of this type.

As shown in FIG. 3, the angle of the louvers is such that in a lowered position of the arms as shown in FIG. 2 the driver can view through the louvers in the direction of the arrow 35 so as to be able to see in front of the bucket and properly load the material. However if the arms are raised to a position in which the rear wall 19 is substantially horizontal, the louvers are arranged in that position at 45° to the horizontal so as to resist movement of any spilled material in the direction of the arrow 36.

The present invention therefore arises from the realization that the louvers can be positioned at an angle which is suitable both for the viewing through the louvers by the driver when the arms in the lowered position and at the same time to prevent the back spill of material when the spill guard and the bucket are tilted to the substantially horizontal position above the loader for a loading action.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A loader comprising:

a vehicle frame;

a cab mounted on the frame for receiving a driver;

a pair of loader arms extending forwardly from the frame and mounted thereon for pivotal movement about a horizontal lift axis on the frame;

lift cylinder means for raising and lowering the arms about the lift axis;

a bucket mounted on a forward end of the arms for pivotal movement about a horizontal bucket axis on the arms;

pivot means for driving the bucket in said pivotal movement;

the bucket having a bottom lift wall, a rear lift wall extending upwardly and forwardly from a rear edge of the bottom lift wall and two side walls;

and a spill guard mounted on the bucket at a top edge of the rear lift wall and extending upwardly therefrom, the spill guard comprising a pair of posts upstanding from the rear wall and substantially coplanar therewith and a plurality of planar plates connected across and supported by the posts, the plates being parallel and spaced to allow viewing therebetween, the plates each having two parallel flat sides with the plates being oriented such that the flat sides are inclined at an angle different from ninety degrees to a plane at right angles to the plane of the posts in a direction so that a front edge of each plate is closer to the bucket than a rear edge of said each plate whereby an operator can see downwardly and forwardly between the plates when the arms are in a lowered position and the plates are inclined to the vertical in a raised position of the arms so as to prevent material from dropping between the plates.

2. The loader according to claim 1 wherein the flat sides of the plates are arranged at an angle of approximately 45° to the plane at right angles to the plane of the posts.

3. A method of operating a loader comprising:

providing a loader including:

a vehicle frame;

a cab mounted on the frame for receiving a driver;

a pair of loader arms extending forwardly from the frame and mounted thereon for pivotal movement about a horizontal lift axis on the frame;

lift cylinder means for raising and lowering the arms about the lift axis;

a bucket mounted on a forward end of the arms for pivotal movement about a horizontal bucket axis on the arms;

and pivot means for driving the bucket in said pivotal movement;

the bucket having a bottom lift wall, a rear lift wall extending upwardly and forwardly from a rear edge of the bottom lift wall and two side walls;

providing a spill guard on the bucket at a top edge of the rear lift wall and extending upwardly therefrom, the spill guard comprising a pair of posts upstanding from the rear wall and substantially coplanar therewith and a plurality of planar plates connected across and supported by the posts;

mounting the plates parallel and spaced with each having two parallel flat sides oriented such that the flat sides are arranged at an inclined orientation at an angle different from ninety degrees to a plane at right angles to the plane of the posts in a direction so that a front edge of each plate is closer to the bucket than a rear edge of said each plate;

with the bucket and arms lowered, viewing forwardly between the plates;

and with the bucket and arms raised, using the inclined orientation of the plates to prevent any material in the bucket from dropping between the plates.

4. The method according to claim 3 including arranging the flat sides of the plates at an angle of approximately 45° to the plane at right angles to the plane of the posts.

* * * * *